US010433619B2

(12) United States Patent
Wong et al.

(10) Patent No.: US 10,433,619 B2
(45) Date of Patent: Oct. 8, 2019

(54) STRAP ADJUSTMENT SYSTEM

(71) Applicant: Duraflex Hong Kong Limited, Hong Kong (CN)

(72) Inventors: Ying Kwan Wong, Hong Kong (CN); Yick Fai Chan, Hong Kong (CN)

(73) Assignee: Duraflex Hong Kong Limited, Hong Kong (CN)

( * ) Notice: Subject to any disclaimer, the term of this patent is extended or adjusted under 35 U.S.C. 154(b) by 0 days.

(21) Appl. No.: 15/867,861

(22) Filed: Jan. 11, 2018

(65) Prior Publication Data

US 2019/0208868 A1 Jul. 11, 2019

(51) Int. Cl.
*A44B 11/12* (2006.01)

(52) U.S. Cl.
CPC ..... *A44B 11/125* (2013.01); *Y10T 24/4016* (2015.01)

(58) Field of Classification Search
CPC ... A44B 11/125; A44B 11/2557; A44B 11/10; A44B 11/12; Y10T 24/4016; Y10T 24/4072; Y10T 24/45623; Y10T 24/44017; Y10T 24/44026
See application file for complete search history.

(56) References Cited

U.S. PATENT DOCUMENTS 909,399 A * 1/1909 Greenwood ..... B65D 63/1018 24/17 A
1,037,613 A * 9/1912 Gizzi ..... A01K 1/04 24/168
3,276,085 A * 10/1966 Spranger ..... A44B 11/10 24/171
3,794,019 A * 2/1974 Ritland ..... A61F 5/10 602/22

(Continued)

FOREIGN PATENT DOCUMENTS

CN 1444885 A 10/2003
CN 203828198 U 9/2014

(Continued)

OTHER PUBLICATIONS

International Search Report of PCT/CN2018/110401, dated Jan. 22, 2019.

*Primary Examiner* — Robert Sandy
*Assistant Examiner* — Rowland Do
(74) *Attorney, Agent, or Firm* — Collard & Roe, P.C.

(57) ABSTRACT

A strap adjustment system has a base body having a bottom wall, two side walls and a strap retaining bar extending between the two side walls, the bottom wall having an aperture therethrough with screw threads extending around an inside surface, and a screw disc having a central protrusion and screw threads extending around the central protrusion. The central protrusion fits through the aperture in the base body by rotating the screw disc so that the threads in the (Continued)

screw disc mate with the threads in the aperture, such that a height of the protrusion above the bottom wall of the base body is adjustable by turning the screw disc. In situations where a high degree of friction is required, the protrusion can be positioned at a maximum height through the aperture, and in situations where a low degree of friction is desired, the protrusion can be positioned lower.

6 Claims, 4 Drawing Sheets

(56) References Cited

U.S. PATENT DOCUMENTS 3,883,928 A * 5/1975 Blake ..... A41F 9/002 24/163 R
4,733,440 A * 3/1988 Ogawa ..... A44B 11/06 24/170
4,782,425 A * 11/1988 Breidegam ..... A61N 1/14 24/170
4,881,303 A * 11/1989 Martini ..... A44B 11/14 24/170
5,864,927 A * 2/1999 Liu ..... A01K 1/0272 24/163 R
5,920,963 A * 7/1999 Chou ..... F16G 11/106 24/170
5,983,463 A * 11/1999 Prentkowski ..... A44B 11/2557 24/171
6,735,826 B2 5/2004 Uehara et al.
6,938,925 B2 * 9/2005 Mather ..... B60R 22/30 24/170
7,000,438 B1 * 2/2006 Cooper ..... E05B 75/00 128/869
7,185,919 B2 * 3/2007 Mather ..... B60R 22/30 24/170
8,181,319 B2 * 5/2012 Johnson ..... A44B 11/253 182/3
8,522,402 B1 * 9/2013 Spooler ..... B60P 7/0846 24/132 R
8,955,200 B2 * 2/2015 Ng ..... A43C 11/148 24/168
9,155,359 B1 10/2015 Bailey
9,827,480 B2 * 11/2017 Mitchell, Jr. ..... A63B 71/10
2006/0032028 A1 2/2006 Takeuchi et al.
2007/0193006 A1 * 8/2007 Kitano ..... A44B 17/0011 24/323
2012/0275853 A1 * 11/2012 Grasso ..... B60P 7/083 403/315
2015/0033457 A1 * 2/2015 Tryner ..... A42B 3/205 2/421
2015/0366299 A1 * 12/2015 Huang ..... A44B 11/12 24/163 R
2016/0123359 A1 * 5/2016 Coles ..... B65D 63/14 24/134 R

FOREIGN PATENT DOCUMENTS

CN 204070955 U 1/2015
JP H10117813 A 5/1998
WO 2014038068 A1 3/2014

* cited by examiner

STRAP ADJUSTMENT SYSTEM

BACKGROUND OF THE INVENTION

1. Field of the Invention

The present invention relates to a strap adjustment system. In particular, the invention relates to a strap adjustment system that can provide an adjustable degree of friction on the strap when the system is in an unlocked position, depending on the use of the system.

2. The Prior Art

Strap adjustment systems often include a hinged element that can be pivoted downward onto a strap and hold the strap in place via friction. In an unlocked state, the strap can slide freely through the system with little or no friction.

However, due to the free sliding of the strap, it can be difficult to position the strap in the proper setting, especially if the system is located in an inconvenient place or if the user has only one hand. It would be desirable to create a strap adjustment system that can keep the strap in place prior to locking, yet allows for adjustments.

SUMMARY OF THE INVENTION

It is therefore an object of the invention to create a strap adjustment system that can keep the strap in place prior to locking, yet allows for adjustments. It is another object of the invention to provide a method wherein the amount of friction on the strap can be adjusted based on the use of the device.

These and other objects are accomplished by a strap adjustment system in which a component with an adjustable height is connected to the strap adjuster to add friction underneath the strap and prevent the strap from coming loose even when the strap is unsecured. The adjustment system comprises a base body having a bottom wall, two side walls and a strap retaining bar extending between the two side walls, the bottom wall having an aperture therethrough with screw threads extending around an inside surface, and a screw disc having a central protrusion and screw threads extending around the central protrusion. The central protrusion fits through the aperture in the base body by rotating the screw disc so that the threads in the screw disc mate with the threads in the aperture, such that a height of the protrusion above the bottom wall of the base body is adjustable by turning the screw disc. In situations where a high degree of friction is required, the protrusion can be positioned at a maximum height through the aperture, and in situations where a low degree of friction is desired, the protrusion can be positioned lower.

Preferably, the protrusion is located directly under the strap retaining bar, and thus decreases the space that is allotted for the strap to slide—the smaller the space, the harder it is for the strap to slide freely. By narrowing the channel between the protrusion and the bar by moving the protrusion close to the bar, the protrusion and the surface of the bar start touching the strap, thereby creating additional friction and the friction will slow down the sliding of the strap The user can control the sliding speed of the strap, by fine tuning the height of the protrusion by turning the disc. In a preferred embodiment, the protrusion has a rounded top surface with ridges for creating friction against a strap when the strap extends through the base body.

In one embodiment, the strap adjustment system can include a cam lid pivotally connected to the two side walls. The cam lid has a top surface and a bottom surface, the bottom surface containing friction-creating elements configured for gripping a strap placed through the base body when the cam lid is lowered. The cam lid can be held in a lowered position by a torsion spring to eliminate the need for manual closing of the cam lid. Preferably, the friction-creating elements are teeth. The cam lid can be connected to the side walls via a pivot rod extending through apertures in the side walls and cam lid.

The adjustable friction system of the invention is especially useful in combination with the cam lock system described above. For example a user carrying a loaded backpack, especially large outdoor backpack, may need to adjust the shoulder strap, for example, to a comfortable level via a cam lock. With heavier loading, the need to do adjustment is even higher. However, the user always needs to repeat these two actions—releasing and tightening the strap system to reach a comfortable level. This is because a traditional cam lock does not provide the fine tuning option described above. The strap slides very quickly once the cam is opened, and the speed of sliding is so fast that the user does not have the chance to sense the comfortable level and to stop the sliding of the strap by closing the cam. The heavier the loading, the faster the strap slides. The present invention solves this problem by slowing down the speed in which the strap can slide freely.

In another embodiment, the base body can be formed by a male portion of a side-release buckle having locking legs that can snap into side openings of a corresponding female portion. A strap is attached to the male portion by wrapping it around the bar. The protrusion acts to prevent the strap from slipping during adjustment.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1A:
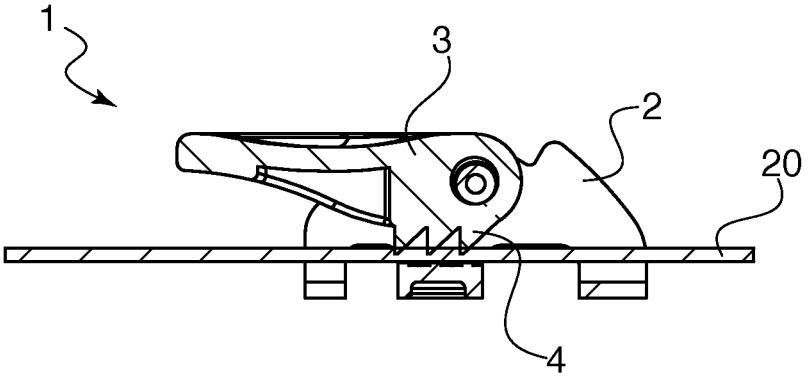
FIG. 1A (Prior Art)
FIGS. 1A and 1B show cross sectional views of a prior art cam locking device.
Figure 1B:
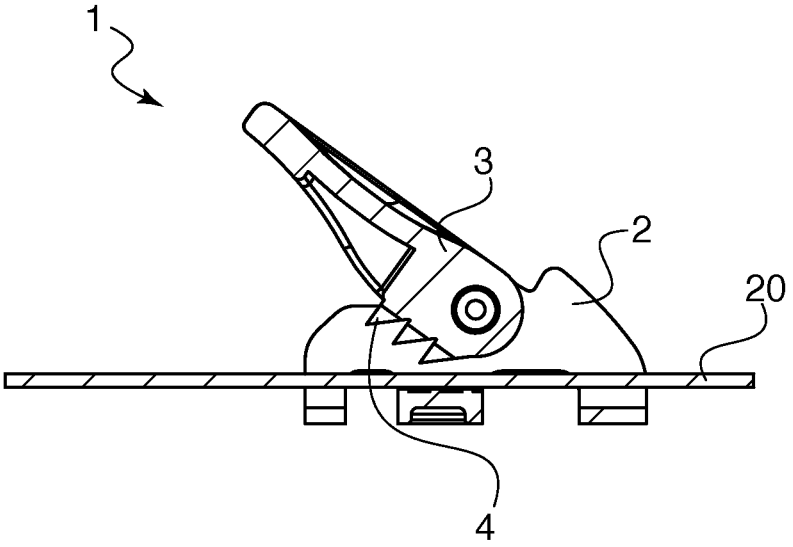
FIG. 1B (Prior Art)

Referring now in detail to the drawings, FIGS. 1A and 1B show a prior art cam lock system 1 having a base 2 and a cam lid 3 with teeth 4 that clamp down on a strap 20 that is fed through base 2. However, as shown in FIG. 2, once cam lid 3 is raised, there is too much clearance above strap 20, and strap 20 can now slide freely with very little friction.

Figure 2:
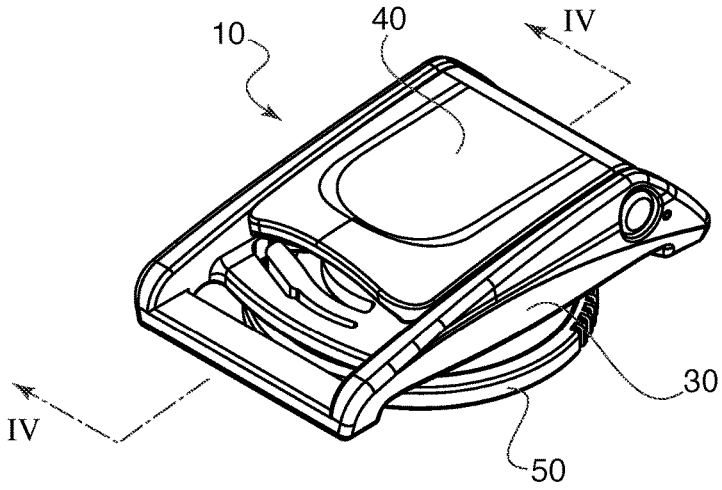
FIG. 2 shows a top view of the strap adjustment device according to the invention.
Figure 3:
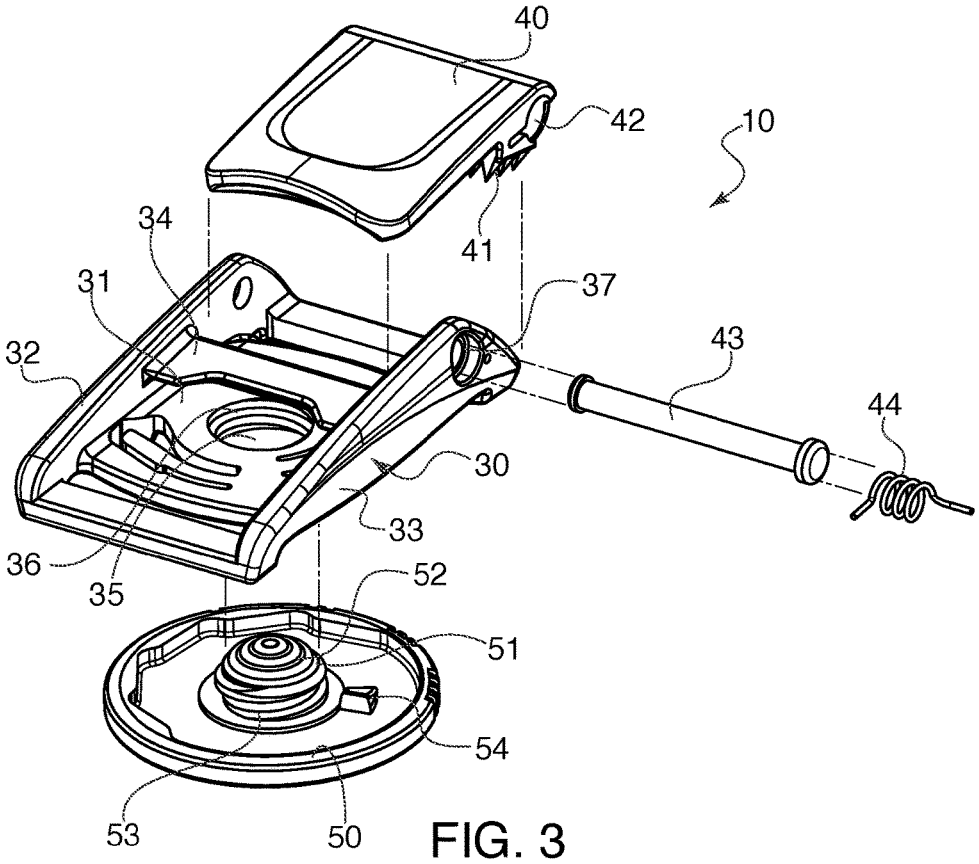
FIG. 3 shows an exploded view of the device of FIG. 2.
Figure 4:
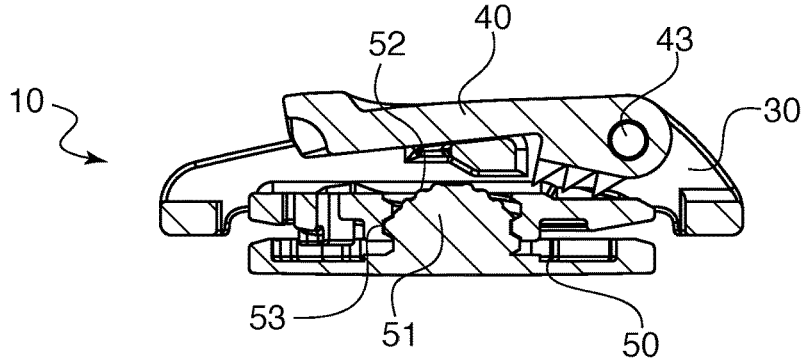
FIG. 4 shows a cross-sectional view along lines IV-IV of FIG. 2.

The strap adjustment system 10 according to the present invention is shown in FIGS. 2-6. Here, the system 10 consists of a base body 30, a cam lid 40 and a screw disc 50. Base body 30 has a bottom wall 31, two side walls 32, 33 and a strap retaining bar 34 disposed between side walls 32, 33. An aperture 35 is disposed in the bottom wall. Aperture 35 is equipped with screw threads 36 around the interior of aperture 35. Holes 37 are disposed in side walls 32, 33 for receiving a bar 43 which is put through holes 42 on cam lid 40, to attach cam lid 40 to base body 30. A torsion spring 44 biases cam lid 40 in a lowered position as shown in FIG. 2. Cam lid 40 is equipped with teeth 41 on an underside to grip a strap 20 when cam lid 40 is in the lowered position. Screw disc 50 has a central protrusion 51 with a rounded top surface that is equipped with ridges 52 or grooves. Protrusion 51 has screw threads 53 surrounding protrusion 51 at least on a lower portion thereof. These screw threads 53 mate with screw threads 36 in aperture 35 in base body 30 to attach screw disc 50 to base body 30. Rotating screw disc 50 a desired amount causes protrusion 51 to be raised and lowered with respect to base body 30. A stop 54 prevents over-turning of screw disc 50 when it is mounted to base body 30.

Figure 5:
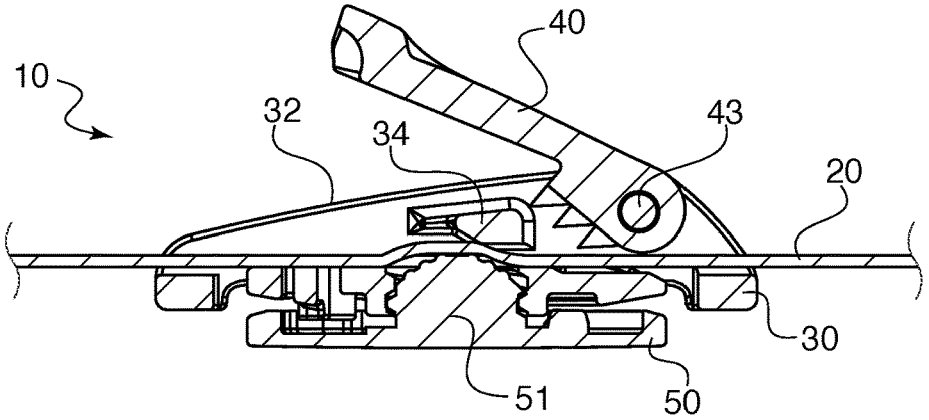
FIG. 5 shows a cross-sectional view of the device of FIG. 4 in a raised position of the cam lid with the protrusion in a lowered position.
Figure 6:
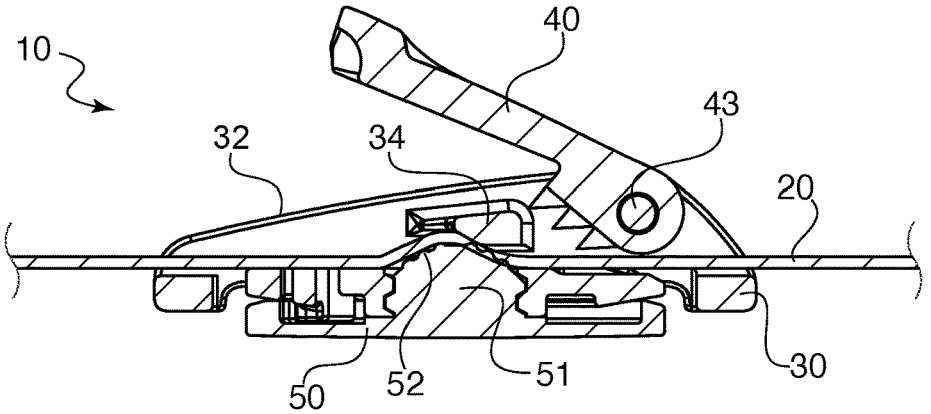
FIG. 6 shows a cross-sectional view of the device of FIG. 4 with the protrusion in a fully raised position.

Strap adjustment system 10 is shown in use in FIGS. 5 and 6, where here, a strap 20 is placed through base body 30 underneath strap retaining bar 34. In FIG. 5, screw disc 50 is rotated so that protrusion 51 is at a lower point, providing only minor additional friction to keep strap 20 in place, as can be seen by the only minor deformation of the strap 20 as it is pressed toward bar 34. In FIG. 6, screw disc 50 is rotated in such a way that protrusion 51 is raised to a higher level, providing additional friction to strap 20, as can be seen by the greater deformation of strap 20 as it presses against bar 34. The user can position protrusion 51 at any desired height to provide the optimal sliding of strap 20 within base body 30.

Figure 7:
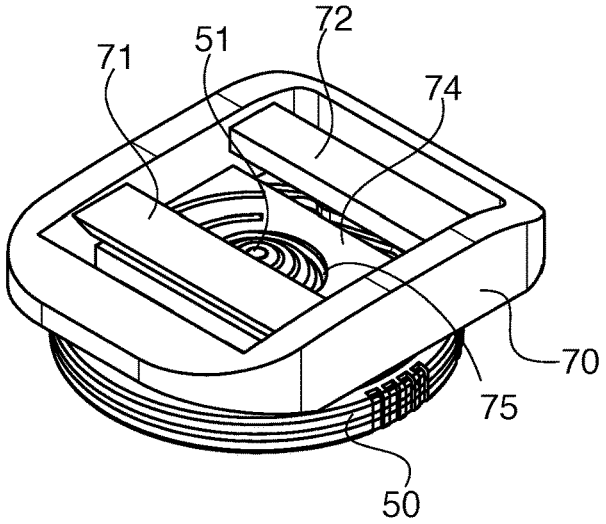
FIG. 7 shows an alternative embodiment of the strap adjustment system according to the invention.
Figure 8:
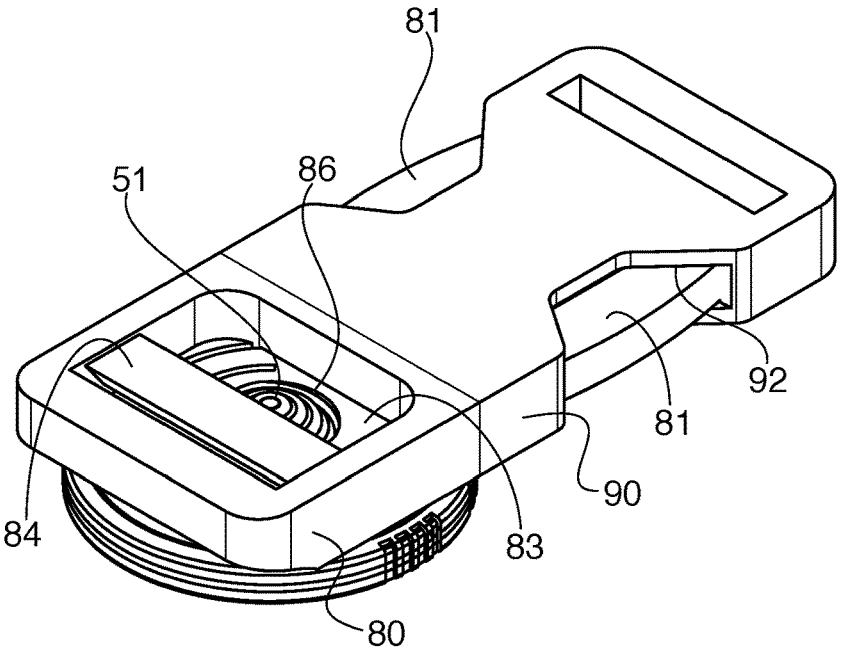
FIG. 8 shows another alternative embodiment of the strap adjustment system according to the invention.

FIGS. 7 and 8 show additional embodiments of the strap adjustment system according to the invention. In FIG. 7, the cam lid is not used, and a strap is tensioned around bars 71, 72 of base body 70. Screw disc 50 extends through aperture 74 equipped with screw threads (not shown). Screw disc 50 operates the same way as described above with respect to FIGS. 5 and 6.

In FIG. 8, the base body is in the form of a male buckle portion 80 that is connected to a female buckle portion 90. Male buckle portion 80 has a pair of locking legs 81 that extend into a cavity of female buckle portion 90 and snap into locking slots 92 of female buckle portion 90. Male buckle portion 80 has a strap retaining bar 84 against which a strap is pressed by protrusion 51 of screw disc 50, which extends through aperture 86 in bottom wall 83 of male portion 80. This aperture 86 is equipped with internal screw threads (not shown). The height of protrusion 51 can be adjusted in the same manner as described above with respect to FIGS. 5 and 6.

Accordingly, while only a few embodiments of the present invention have been shown and described, it is obvious that many changes and modifications may be made thereunto without departing from the spirit and scope of the invention.

What is claimed is:

1. A strap adjusted system comprising:

a base body having a bottom wall with a top surface and a bottom surface, two side walls and a strap retaining bar extending between the two side walls, the bottom wall having an aperture there through, said aperture having screw threads extending around an inside surface thereof;

a screw disc having a central protrusion and screw threads extending around the central protrusion, the central protrusion being adapted to fit through the aperture in the base body and extend above the top surface of the bottom wall by rotating the screw disc so that the threads in the screw disc mate with the threads in the aperture, such that a height of the protrusion above the top surface of the bottom wall of the base body is adjustable by turning the screw disc, a strap extending through the base body in between the side walls, the strap having an upper surface and a lower surface, wherein the central protrusion presses against the lower surface of the strap, causing friction to prevent the strap from sliding through the base body, and wherein the amount of friction is based on the height of the protrusion so that the amount of friction on the strap is adjustable by turning the screw disc, and a cam lid pivotally connected to the two side walls and being disposed above an upper surface of the strap, the cam lid having a top surface and a bottom surface, the bottom surface containing friction-creating elements configured for gripping the upper surface of the strap when the cam lid is lowered.

2. The strap adjustment system according to claim 1, wherein the cam lid is held in a lowered position by a torsion spring.

3. The strap adjustment system according to claim 1, wherein the function-creating elements are teeth.

4. The strap adjustment system according to claim 1, wherein the cam lid is connected to the side walls via a pivot rod extending through apertures in the side walls and cam lid.

5. The strap adjustment system according to claim 1, wherein the protrusion has a rounded top surface with a circumferential ridges for creating friction against a strap when the strap extends through the base body.

6. The strap adjustment system according to claim 1, wherein the base body further comprises a male buckle portion having locking legs, and further comprising a female portion, wherein the locking legs are adapted to snap into side openings of the female portion.

* * * * *